US007912402B2

(12) United States Patent
Mori

(10) Patent No.: US 7,912,402 B2
(45) Date of Patent: Mar. 22, 2011

(54) DEVELOPING DEVICE WITH LEAKAGE PREVENTING MEMBER, PROCESS CARTRIDGE WITH LEAKAGE PREVENTING MEMBER, AND METHOD FOR ATTACHING DEVELOPING ROLLER TO DEVELOPER CONTAINER

(75) Inventor: Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 777 days.

(21) Appl. No.: 11/672,698

(22) Filed: Feb. 8, 2007

(65) Prior Publication Data

US 2007/0264042 A1 Nov. 15, 2007

(30) Foreign Application Priority Data

Feb. 8, 2006 (JP) ..... 2006-030551

(51) Int. Cl.
*G03G 15/08* (2006.01)

(52) U.S. Cl. ..... 399/103

(58) Field of Classification Search ..... 399/103, 399/105, 119, 110

See application file for complete search history.

(56) References Cited

U.S. PATENT DOCUMENTS

| | | | | |
|---|---|---|---|---|
| 6,321,050 | B1 | 11/2001 | Sato et al. | |
| 6,356,723 | B1 | 3/2002 | Sato et al. | |
| 6,496,668 | B2 * | 12/2002 | Sato et al. | 399/103 |
| 6,496,669 | B2 | 12/2002 | Sato et al. | |
| 6,760,555 | B2 * | 7/2004 | Dougherty et al. | 399/103 |
| 6,937,831 | B2 * | 8/2005 | Kamimura | 399/103 |
| 7,215,902 | B2 * | 5/2007 | Ishii | 399/103 |
| 7,251,435 | B2 * | 7/2007 | Ohgoshi et al. | 399/103 |
| 2002/0028086 | A1 | 3/2002 | Sato et al. | |
| 2002/0090226 | A1 * | 7/2002 | Sato et al. | 399/103 |
| 2002/0141777 | A1 * | 10/2002 | Kamimura et al. | 399/103 |
| 2002/0141778 | A1 * | 10/2002 | Itabashi | 399/103 |

FOREIGN PATENT DOCUMENTS

| | | | |
|---|---|---|---|
| JP | 2001-027846 | A | 1/2001 |
| JP | 2001-134080 | | 5/2001 |
| JP | 2001-356593 | A | 12/2001 |
| JP | 2004-133077 | A | 4/2004 |

OTHER PUBLICATIONS

JP Office Action dtd Oct. 12, 2010, JP Appln. 2007-026551, partial English translation.

* cited by examiner

*Primary Examiner* — Susan S Lee
(74) *Attorney, Agent, or Firm* — Banner & Witcoff, Ltd.

(57) ABSTRACT

An aspect of the invention provides a developing device including: a developer container that contains developer and is formed with an opening; a developing roller that is rotatably supported by the developer container at a predetermined position and includes a roller shaft and an elastic roller configured to carry the developer; leakage preventing members that prevent leakage of the developer at longitudinal end portions of the elastic roller and each of which is respectively disposed at portions, where the longitudinal end portions oppose the developer container, to extend in an extending direction along a circumferential surface of the elastic roller at a longitudinal end portion thereof; and a guide that is provided on the developer container and slidably guides the developing roller toward the predetermined position along a sliding direction that is defined along the extending direction to allow the developing roller to be attached to the developer container.

17 Claims, 14 Drawing Sheets

DEVELOPING DEVICE WITH LEAKAGE PREVENTING MEMBER, PROCESS CARTRIDGE WITH LEAKAGE PREVENTING MEMBER, AND METHOD FOR ATTACHING DEVELOPING ROLLER TO DEVELOPER CONTAINER

CROSS-REFERENCE TO RELATED APPLICATION

This application claims priority from Japanese Patent Application No. 2006-030551, filed on Feb. 8, 2006, the entire subject matter of which is incorporated herein by reference.

TECHNICAL FIELD

Aspects of the present invention relate to a developing device using developer, such as toner, an image forming device and a process cartridge.

BACKGROUND

An electrophotography-based image forming device such as a laser printer electrostatically feeds developer, such as toner, on an electrostatic latent image formed on a photosensitive member to develop a toner image. The toner image is transferred to a recording medium (for example, a sheet) to form an image. The developer is contained in a developer container (case) of a developing device and provided for development to a developing roller, such as a developing roller, rotatably supported at a predetermined position along an opening of the developer container.

When the developer contained in the developer container is leaked out from the developer container, the developer scatters to stain the interior of the image forming device and the recording medium. In order to prevent the leakage of developer as described above, for example, JP-A-2001-134080 discloses an image forming device including developer leakage preventing members called side seals respectively disposed at portions, where the longitudinal end portions of the developing roller oppose the developer container. The developer leakage preventing members prevent the leakage of the developer. The substrate of the side seal is made of an elastic material, such as urethane sponge. Since the developing roller is attached so as to press the side seal, the longitudinal end portions of the developing roller strongly contact with the side seals, respectively. Therefore, even when the developing roller rotates, the toner is prevented from leaking from the longitudinal end portions of the developing roller.

The side seal 109 (refer to FIG. 13B) is made of an elastic material such as urethane sponge and has a certain thickness so that when a developing roller 22 is attached to a case 21 of a developing cartridge 4, the side seal 109 is compressed and exerts a predetermined pressing force to the developing roller 22. When the developing roller 22 is attached to the case 21 of the developing cartridge 4, such a method is employed that a shaft of the developing roller is inserted into a supporting hole 21*d* formed on a case side portion 21*a* of the developing cartridge 4 and the developing roller 22 is placed on a side seal 109.

However, since the side seal 109 is, as described above, made of an elastic material having a certain thickness, a direction to which the side seal 109 is pressed and forcibly deformed is varied depending on how the developing roller 22 presses the side seal 109. Specifically, a shape of the side seal 109 at the time when the developing roller 22 is attached is very difficult to control with collapse of the side seal 109 taken into account. As one example shown in FIG. 13B, when the developing roller 22 is attached so as to press down the side seal 109 downward (in a direction apart from a blade 26), a large clearance 100 is formed in the vicinity of an upper end side 109*e* of the side seal 109. Then, the developer leaks from the clearance 100 and the developer scatters inside an image forming device.

SUMMARY

An aspect of the invention provides a developing device including: a developer container that contains developer and is formed with an opening for providing the developer; a developing roller that is rotatably supported by the developer container at a predetermined position to be disposed along the opening and includes, a roller shaft, and an elastic roller that is supported by the roller shaft and is configured to carry the developer provided through the opening; leakage preventing members that are made of elastic material and prevent leakage of the developer at longitudinal end portions of the elastic roller, each of which is respectively disposed at portions where the longitudinal end portions oppose the developer container, to extend in an extending direction along a circumferential surface of the elastic roller at a longitudinal end portion thereof; and a guide that is provided on the developer container and slidably guides the developing roller toward the predetermined position along a sliding direction that is defined along the extending direction to allow the developing roller to be attached to the developer container.

BRIEF DESCRIPTION OF THE DRAWINGS

In the accompanying drawings:

FIG. 11A is a brief sectional view taken along the line of A-A of FIG. 2;

DETAILED DESCRIPTION

First Example

Next, description will be made for a first example of a laser beam printer according to the present invention.

Configuration of Image Forming Device

Figure 1:
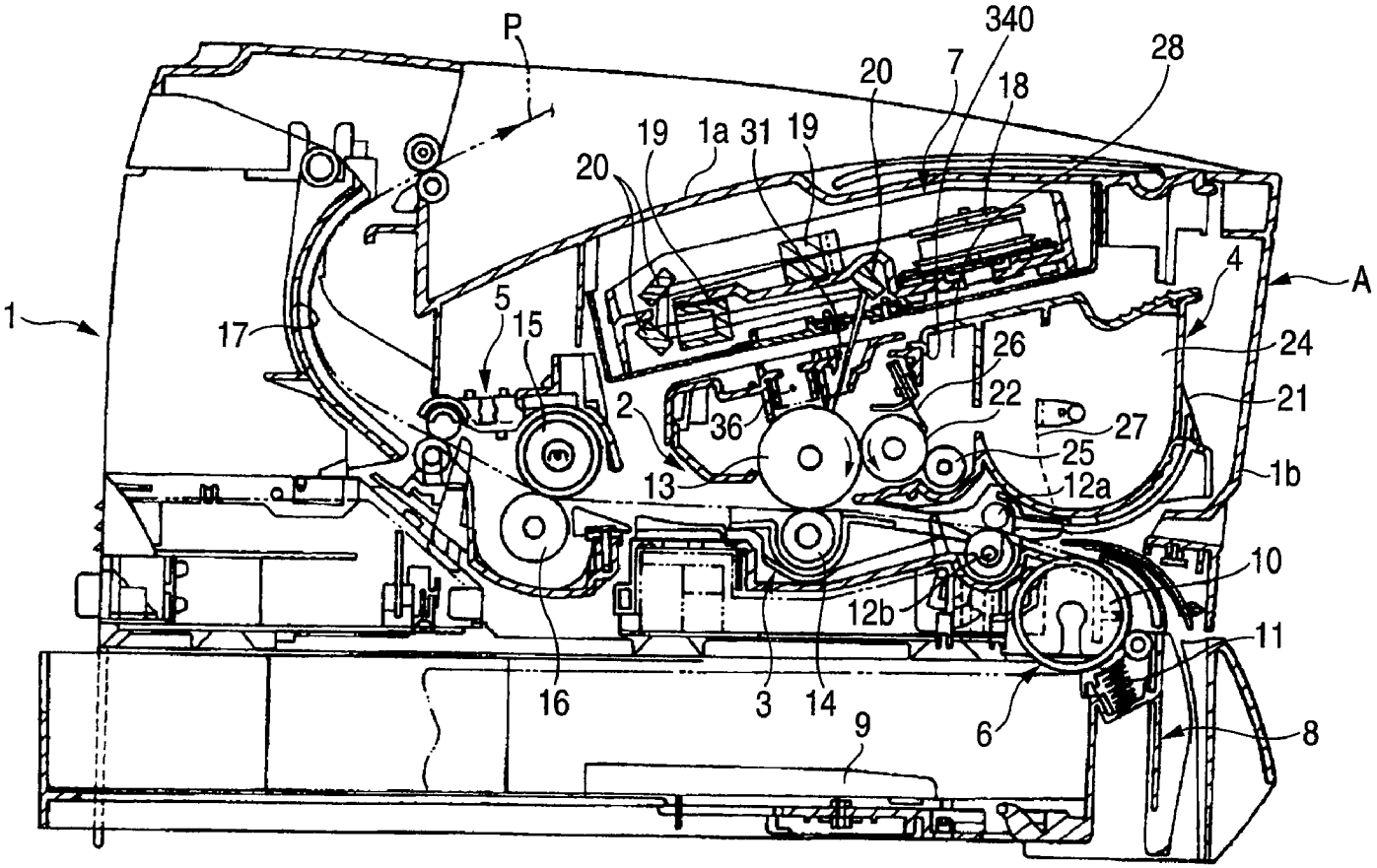
FIG. 1 is a brief side sectional view of a printer.

FIG. 1 is a brief side-sectional view showing a printer as an image forming device. As shown in FIG. 1, a process cartridge 2 including a photosensitive cartridge 3 and a developing cartridge 4 is arranged inside a main housing 1 of the printer approximately at the center thereof. The process cartridge 2 is configured to be attachable to and detachable from the main housing 1 in a state where a lid lb on a right end (on a front face) of the main housing 1 in FIG. 1 is rotated downward and opened.

A fixing unit 5 is arranged on a left side in FIG. 1 adjacent to the process cartridge 2. A sheet feeding unit 6 is arranged below the process cartridge 2 so that a sheet feeding cassette 8 is attachable from a front face (indicated by the arrow A shown in FIG. 1) below the main housing 1. Further, a laser scanner unit 7 is mounted on a frame below the lower face of a synthetic resin sheet discharging tray 1*a*, which is also used as a cover. The laser scanner unit includes a laser light emitting unit, a polygon mirror 18, a plurality of lenses 19, a plurality of reflecting mirrors 20 and others.

When a print data is sent from an external device (not shown), for example, a personal computer in response to a print instruction, cut sheets P each being a recording medium stacked on a supporting plate 9 of the sheet feeding cassette 8 are separated into single sheets by a separation pad 11 as a sheet feeding roller 10 in a sheet feeding unit 6 is rotated. Then, the separated sheet is conveyed through a pair of registration rollers 12*a* and 12*b* between a photosensitive drum 13 (a photosensitive member) in the process cartridge 2 and a transfer roller 14 (a transfer unit) pressing the conveyed sheet to the lower face of the photosensitive drum 13. On the other hand, a laser beam emitted from an emission hole at the lower face of the frame supporting the laser scanner unit 7 is irradiated on an upper face of the photosensitive drum 13 through a window opening 31 at an upper side of the process cartridge 2. Then, the peripheral face of the photosensitive drum 13 is exposed with the light in accordance with the print data and an electrostatic latent image is formed.

Further, as will be described later, toner (developer) provided from a developing roller 22 on the developing cartridge 4 is fed on the electrostatic latent image to be visible. Then, a visible image by the toner on the photosensitive drum 13 is transferred to a sheet P. Thereafter, the sheet P is transferred between a heating roller 15 and a pressing roller 16 in the fixing unit 5 and subjected to be heated and fixed and then discharged from a sheet discharging path 17 to the sheet discharging tray 1*a*. The sheet P is conveyed inside the image forming device along a conveying path (conveying mechanism) shown by the two-dot chain line in FIG. 1, and an image is formed on a surface of the sheet P by the toner provided on the photosensitive drum 13.

In the first example, the process cartridge 2 includes: a photosensitive cartridge 3 having at least a photosensitive drum 13; and a developing cartridge 4 having at least a developing roller 22 attached to a case 21 as a developer container. The developing cartridge 4 is attachable to and detachable from the photosensitive cartridge 3. The process cartridge 2 including the developing cartridge 4 and photosensitive cartridge 3 is attachable to and detachable from the image forming device. The developing cartridge 4 is attachable to and detachable from the image forming device separately from the photosensitive cartridge 3. Although the developing device according to the first example is configured to be attachable to and detachable from the image forming device as described above, the present invention may be applicable to a developing device that is fixed inside an image forming device.

A photosensitive drum 13 is rotatably supported so as to rotate at one side of a synthetic resin case of the photosensitive cartridge 3. The photosensitive drum 13 includes an organic photosensitive agent mainly composed of positively charged materials such as positively charged polycarbonate. The photosensitive drum 13 has a hollow cylindrical shape with a hollow. Specifically the photosensitive drum 13 includes an aluminum cylindrical sleeve as a body and a photoconductive layer with a predetermined thickness (for example, 20 μm), which includes a photoconductive resin dispersed with polycarbonate and is formed around the body. The photosensitive drum 13 is rotatably supported while the cylindrical sleeve is kept grounded. The photosensitive drum 13 is rotated and driven by a driving unit (not shown) in a direction shown by an arrow in FIG. 1. The transfer roller 14 (a transfer unit) is arranged below the photosensitive drum 13, and a bottom face of the photosensitive cartridge 3 is therebelow. The transfer roller 14 is axially supported to move vertically to separate from the lower face of the photosensitive drum 13 by its own weight. The transfer roller 14 is urged upwardly by springs (not shown) arranged on the right and left ends inside the main housing 1 to move and press a lower face (transfer area) of the photosensitive drum 13 when set inside the main housing 1 as a component of the process cartridge 2.

The window opening 31 for irradiating the upper face of the photosensitive drum 13 with the laser light from the laser scanner unit 7 is formed longitudinally along an axial direction of the photosensitive drum 13 at an upper wall covering above the photosensitive drum 13 in a case of the photosensitive cartridge 3. Further, a charger 36 such as a scorotron for charging a photosensitive face of the photosensitive drum 13 is arranged adjacent to the window opening 31. The laser light scans the surface of the photosensitive drum 13 which is uniformly charged by the charger 36, whereby an electrostatic latent image is formed and thin layer toner provided by the developing roller 22 to be described later is fed on the electrostatic latent image, which is then visible (manifested) and transferred to sheet P at a pressing transfer area between the transfer roller 14 and the photosensitive drum 13.

Configuration of Developing Cartridge

Next, a description will be made for the configuration of the developing cartridge 4 by referring to FIG. 1 through FIG. 4. In the following description, the "left side face" is a side face located on the left when a main housing 1 of a printer is viewed from the front face (arrow A), and the "right side face" is a side face on the opposite side.

As shown in FIG. 1, an agitator 27 is rotated inside a toner container 24 having a shape of downward convex curvature of a case 21 of the developing cartridge 4. Accordingly, the toner contained inside the toner container 24 is released to a developing chamber 28. The toner contained in the toner container 24 is developer of positively charged nonmagnetic single components. The toner contains core particles having a spherical shape with diameters of 5 μm to 10 μm and the volume mean particle diameter of 10 μm. The core particles are formed by a polymerization method such as a suspension polymerization method after known coloring agents such as carbon black and charge control agents such as nigrosine, triphenylmethane and quaternary ammonium salt are added to a mixture monomer of styrene with acryl. A core particle is added with silica as an external additive to the surface of the particles. The thus formed polymerized toner is high in fluidity and able to provide a highly elaborate development. The toner released into the developing chamber 28 is held on an outer peripheral face of the developing roller 22 through a providing roller 25 to form a layer. The layer thickness of the developer is regulated by a blade 26 (a regulating member).

Figure 2:
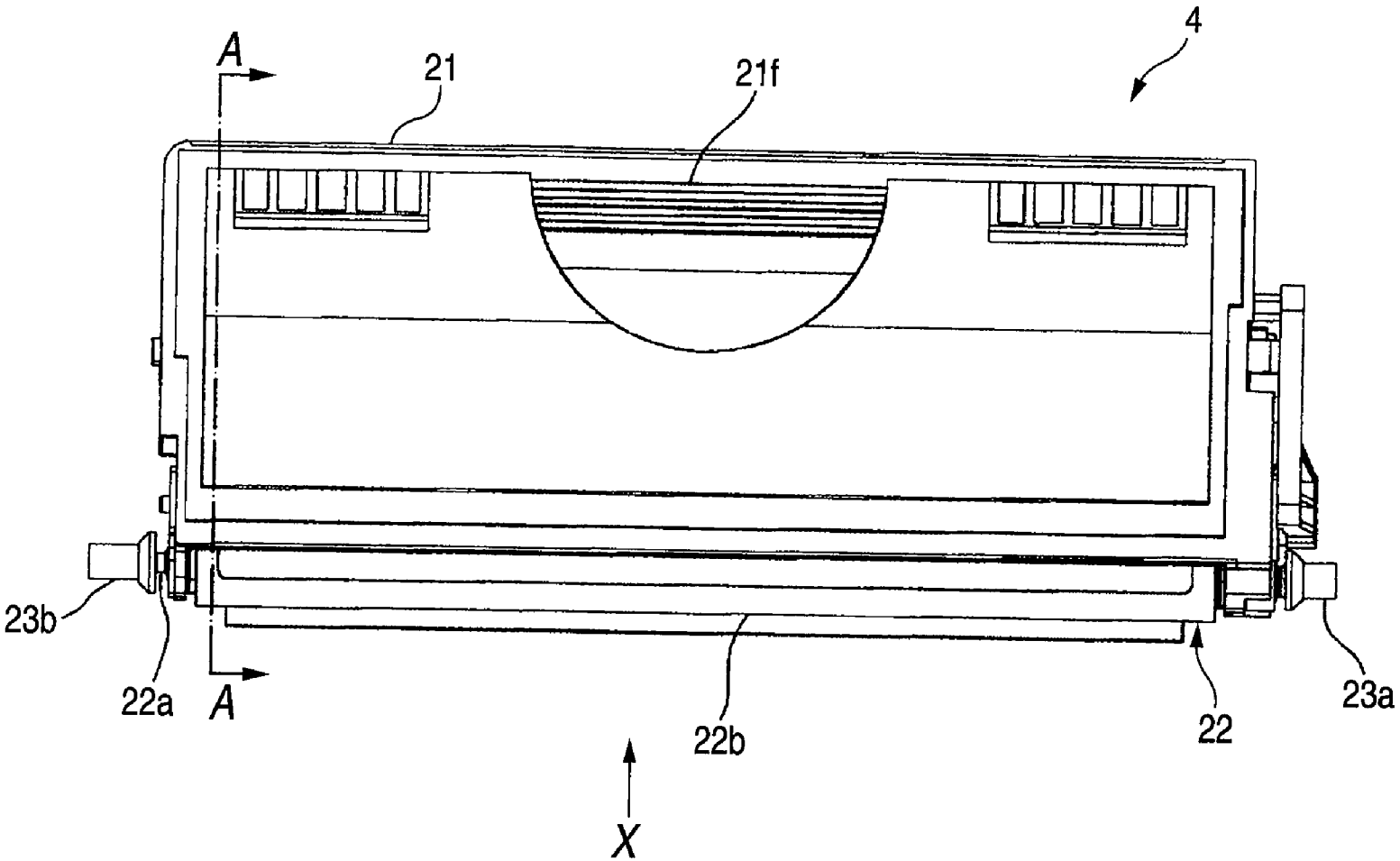
FIG. 2 is an upper face view of a developing cartridge.
Figure 3:
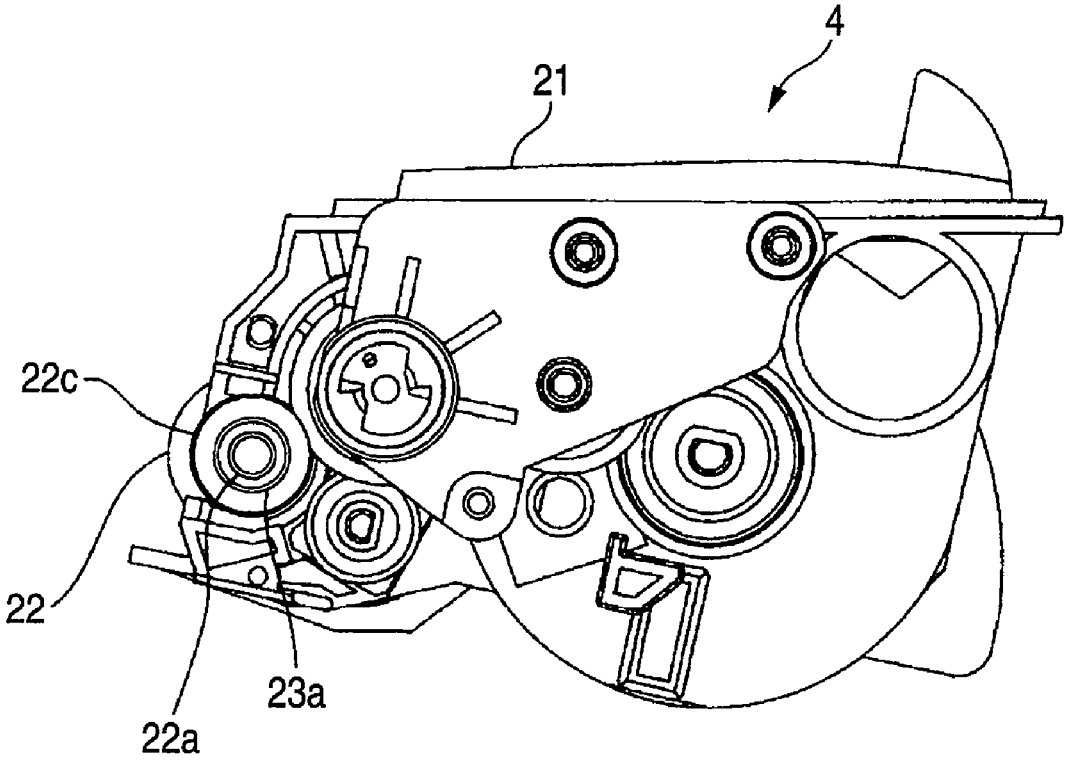
FIG. 3 is a left side view of the developing cartridge.

As shown in FIG. 2, the developing roller 22 is rotatably supported at one end (an opening at the side of the photosensitive drum 13) of the case 21 of the developing cartridge 4. The developing roller 22 includes a developing roller shaft 22*a* (roller shaft) made of metal such as stainless steel and a rubber roller 22*b* (elastic roller) that is supported by the developing roller shaft 22*a* and composed of a substrate given an electrical conductivity by dispersing carbon black to silicon rubber or urethane rubber. A fluorine-containing coat layer is formed on the surface of the rubber roller 22*b*. Bearings 23*a* and 23*b* made of a material such as polyacetal resin with small friction coefficient are rotatably capped on the right and left ends of the developing roller shaft 22*a*. Knob portions 21*f* for easily carrying or handling the developing cartridge 4 are provided respectively on the upper face and on the lower face of the case 21 of the developing cartridge 4 (only the upper face is shown in FIG. 2).

Configuration of Seal Member on Developing Cartridge

The case 21 of the developing cartridge 4 further includes a leakage preventing member that prevents leakage of the toner from the case 21. Next, a description will be made for a seal member which is one example of the leakage preventing member by referring to FIG. 5, FIGS. 11A and 10B.

An opening 340 is formed along an axial direction of the developing roller 22 at one end of the case 21 of the developing cartridge 4 (refer to FIG. 1). The opening 340 is formed in a rectangular shape surrounded by an opening upper end 340*a* defining an upper end side in the longitudinal direction of the opening 340, an opening lower end 340*b* defining a lower end side in the longitudinal direction of the opening 340 and opening side ends 340*c* and 340*c* defining both end sides in a transverse direction.

Figure 10A:
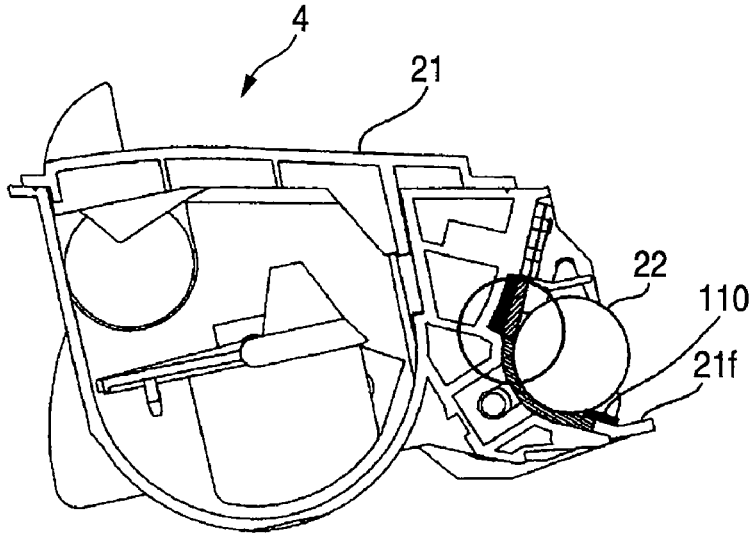
FIG. 10B is an enlarged view of major parts in FIG. 10A.

An upper seal 108 made of urethane sponge is attached to an area adjacent to the upper end 340*a* of the opening 340, that is, an upper area of the upper end 340*a*. The upper seal 108 extends in a longitudinal direction over a length substantially equal to the upper end 340*a* and includes sagged portions 108*e* that hang down so as to hang over upper areas adjacent to the both ends 340*c* and 340*c* of the opening 340, a lower end 108*f* of the sagged portion 108*e* at the end of the sagged portion 108*e* is in contact with a shoulder 21*e* formed on the case 21 (refer to FIGS. 10A and 10B). As will be described later, a blade 26 is attached to the case 21 so that the blade 26 overlaps with the upper seal 108. This configuration prevents toner leakage from above the opening 340 of the case 21 of the developing cartridge 4 or toner leakage which may occur when the developing cartridge 4 is inverted.

Side seals 109 (leakage preventing members) are attached on areas below the descent portions 108*e* of the upper seal 108 and adjacent to the opening both ends 340*c* and 340*c* of the case 21, that is, on side areas of the opening at both ends 340*c* and 340*c*. The side seals 109 prevent the toner leakage from both end portions of the rubber roller 22*b* by slidably contacting with both end portions of the rubber roller 22*b*. Each side seal 109 is made of urethane sponge relatively high in stiffness among sponges (e.g. Poron® manufactured by Rogers Inoac Corporation), and has a certain thickness for exerting a predetermined pressing force when the developing roller 22 is attached and the side seals 109 are compressed. Each side seal 109 is attached to the case 21 by a double side adhesive tape or the like in an extending direction along a circumferential surface of the rubber roller 22*b* at a longitudinal end portion thereof. Each side seal 109 is disposed between both end portions of the rubber roller 22*b* and the case 21 which is opposed to the both end portions.

A lower film 110, which has a width substantially equal to the lower end 340*b* of the opening 340, is attached to an area adjacent to the lower end 340*b* of the opening 340, that is, a lower area of the lower end 340*b*. The lower film 110 is made of, for example, a PET sheet or urethane rubber film. In the first example, a PET sheet is used. The lower film 110 is attached to a part of the lower front edge 21*f* of the case 21 by a double side adhesive tape (refer to FIGS. 11A and 10B). The upper end side 110*e* of the lower film 110 is configured to slidably contact with a circumferential face of the developing roller 22. The lower film 110 is attached as described above, thereby preventing toner leakage from a lower part of the opening 340 of the case 21 of the developing cartridge 4.

Figure 6A:
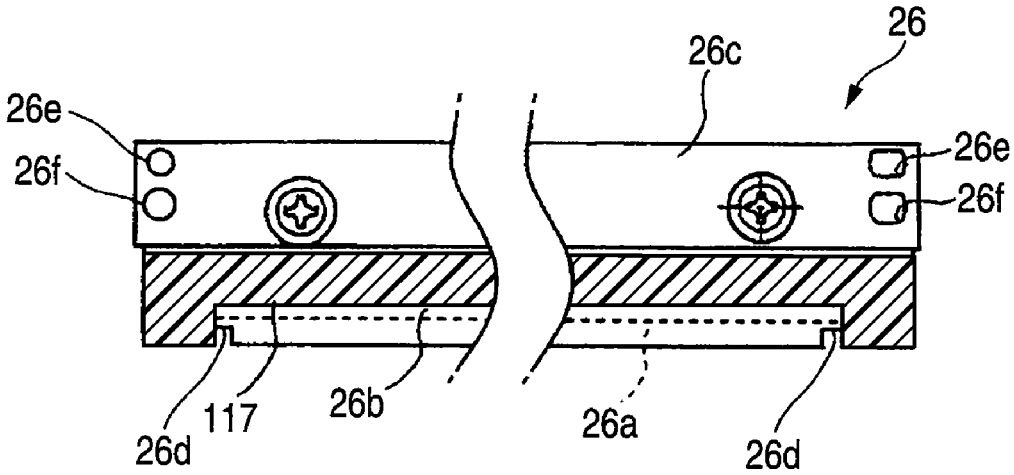
FIG. 6A is a view of the blade when viewed from the back thereof.
Figure 6B:
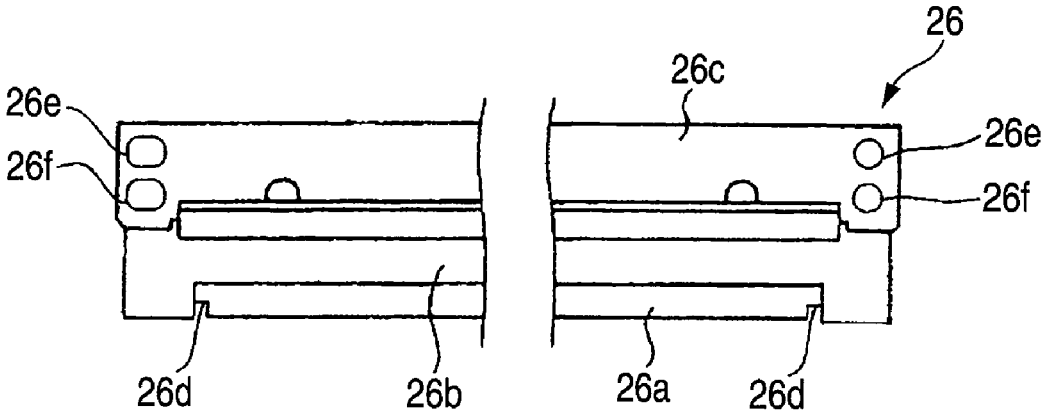
FIG. 6B is a view of the blade when viewed from the front thereof.
Figure 7:
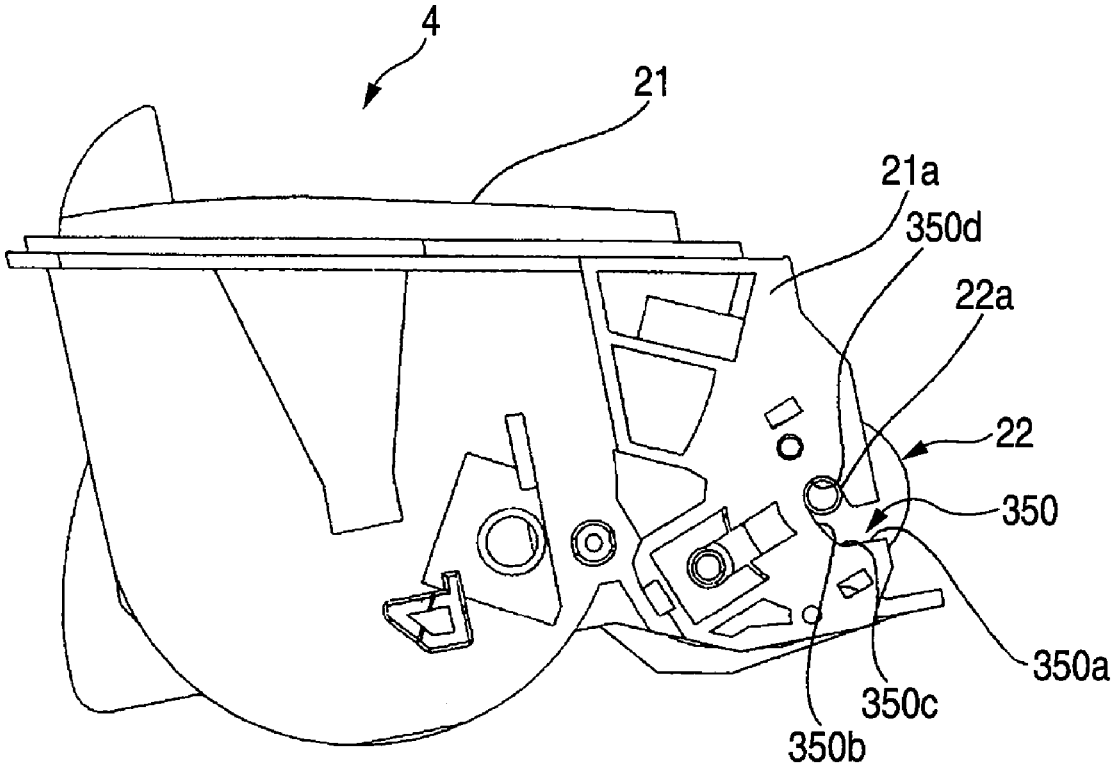
FIG. 7 is a right side view of the developing cartridge before the developing roller is attached.
Figure 8:
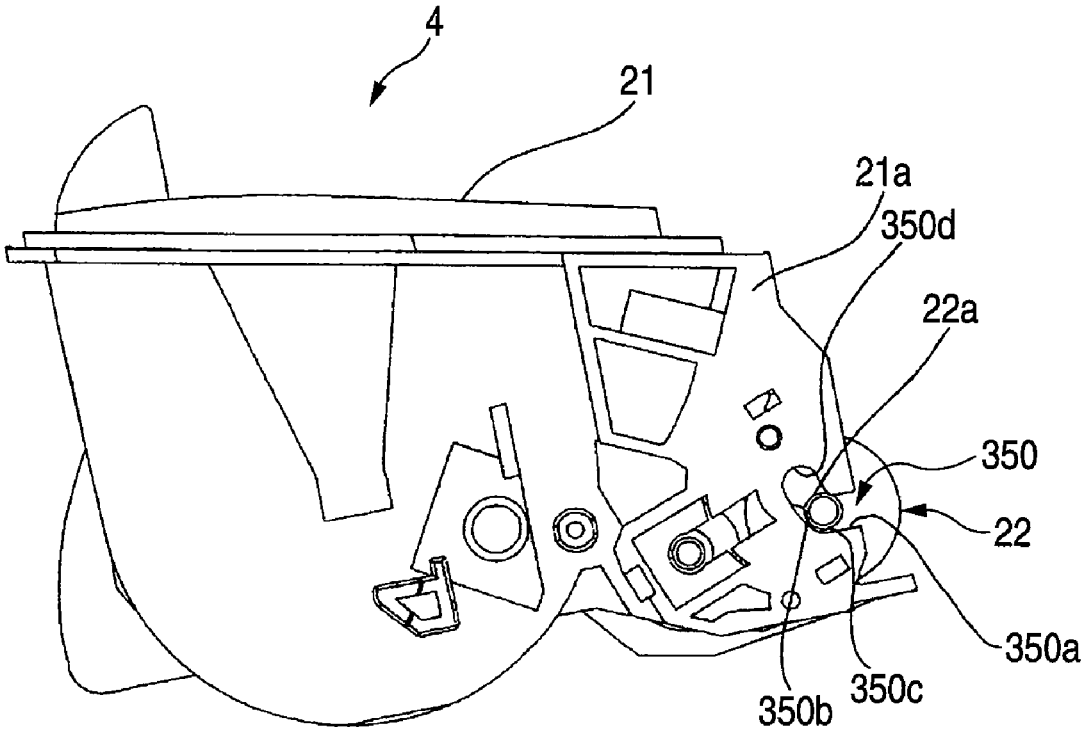
FIG. 8 is a right side view of the developing cartridge in a process of attaching the developing roller.

After the upper seal 108, the side seal 109 and the lower film 110 are attached, the blade 26, shown in FIGS. 6A and 6B, is attached to the case 21 while the blade 26 overlaps with the upper seal 108.

As shown in FIGS. 6A and 6B, the blade 26 includes: a supporting member 26*c* made of iron, stainless steel or the like; a thin plate-shaped leaf spring 26*b* made of phosphor bronze, stainless steel or the like mounted on the supporting member 26*c*; a pressing member 26*a* made of silicon rubber mounted on the leaf spring 26*b*. Notched portions 26*d* notched concavely are formed in the vicinity of the ends of the leaf spring 26*b*. The pressing member 26*a* is made of silicon rubber and has a shape being notched in a width similar to that of the notched portions 26*d*.

Figure 5:
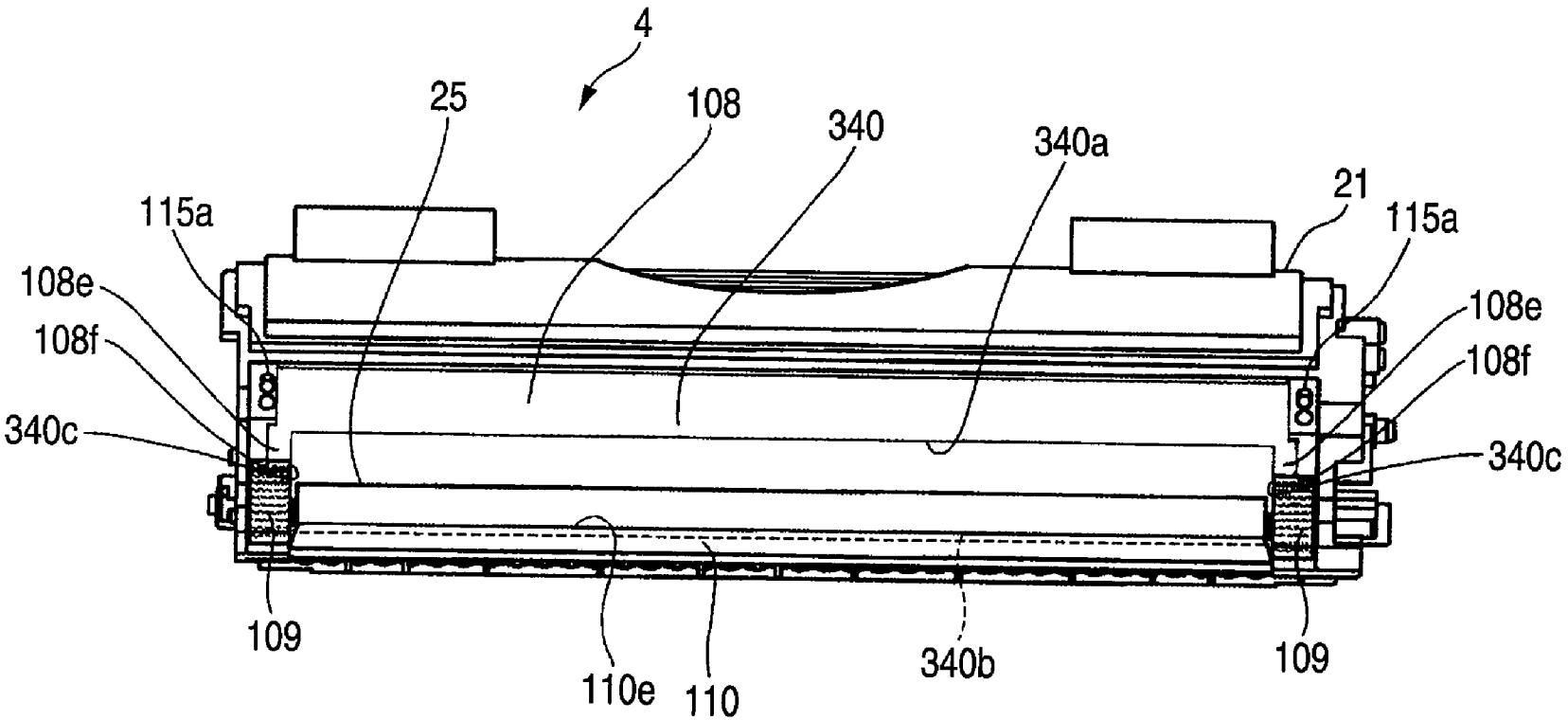
FIG. 5 is a view of the developing cartridge before a blade and a developing roller are attached when viewed from a direction X of FIG. 2.

The blade 26 is attached to the case 21 while a boss 115*a* of the case 21, shown in FIG. 5, fits into a boss hole 26*e* formed on the supporting member 26*c* and screwing through a threaded hole 26*f* also formed on the supporting member 26*c*. Thereafter, the developing roller 22 is attached to the case 21, by which the pressing member 26*a* is configured to be in press-contact with the peripheral face of the developing roller 22 by an elastic force of the leaf spring 26*b* and the elastic force of silicon rubber itself. Therefore, the layer thickness of the toner on the developing roller 22 is regulated to a desired amount.

As shown in FIG. 6A, the leaf spring includes a rib sponge 117 (first attached member) formed to have substantially the same width as the length of the leaf spring 26*b* in the longitudinal direction and also has an approximately U-lettered shape so as not to block the notched portion 26*d* is attached to the leaf spring 26*b* by using a double side adhesive tape. The rib sponge 117 is made of urethane sponge thicker than an upper seal 108. When the blade 26 is attached to the case 21, the rib sponge 117 press-contacts with the upper seal 108 (refer to FIGS. 11A and 10B). It is thereby possible to prevent toner from entering into the back face of the blade 26 and also prevent non-charged toner from feeding on the back face of the blade.

Next, description will be made for a configuration of the case 21 of the developing cartridge 4 to which the developing roller 22 is attached and a method for attaching the developing roller 22 by referring to FIG. 7 through FIG. 10B. The "thickness" of the side seal 109 described in the following indicates a thickness in a thickness direction perpendicular to a sliding surface that is defined between the side seal 109 and the rubber roller 22*b*.

In order to attach the developing roller 22 to the case 21 of the developing cartridge 4, a developing roller shaft 22*a* is inserted from each guide notch 350 formed on case side 21*a* of the case 21 on both sides of the developing roller 22 in a longitudinal direction. A developing roller shaft 22*a* is moved up to a second end portion 350*d* of each guide notch 350, which is a attaching completion position (predetermined position) while the developing roller shaft 22*a* slides along the guide notch 350. The guide notch 350 includes a first guide notch 350*a* extending from an opening-side front edge 21*b* at the case side 21*a* in the thickness direction of the side seal 109 and a second guide notch 350*b* extending along the extending direction of the side seal 109 up to the second end portion 350*d*. The end portion of the first guide notch 350*a* is constituted as the first end portion 350*c*.

The developing roller 22 moves up to the first end portion 350*c* while the developing roller shaft 22*a* slides along the first guide notch 350*a*. The first end portion 350*c* is configured so that the rubber roller 22*b* compresses the side seal 109 in the thickness direction when the developing roller 22 is at the first end portion 350*c* (refer to FIG. 8).

Figure 9:
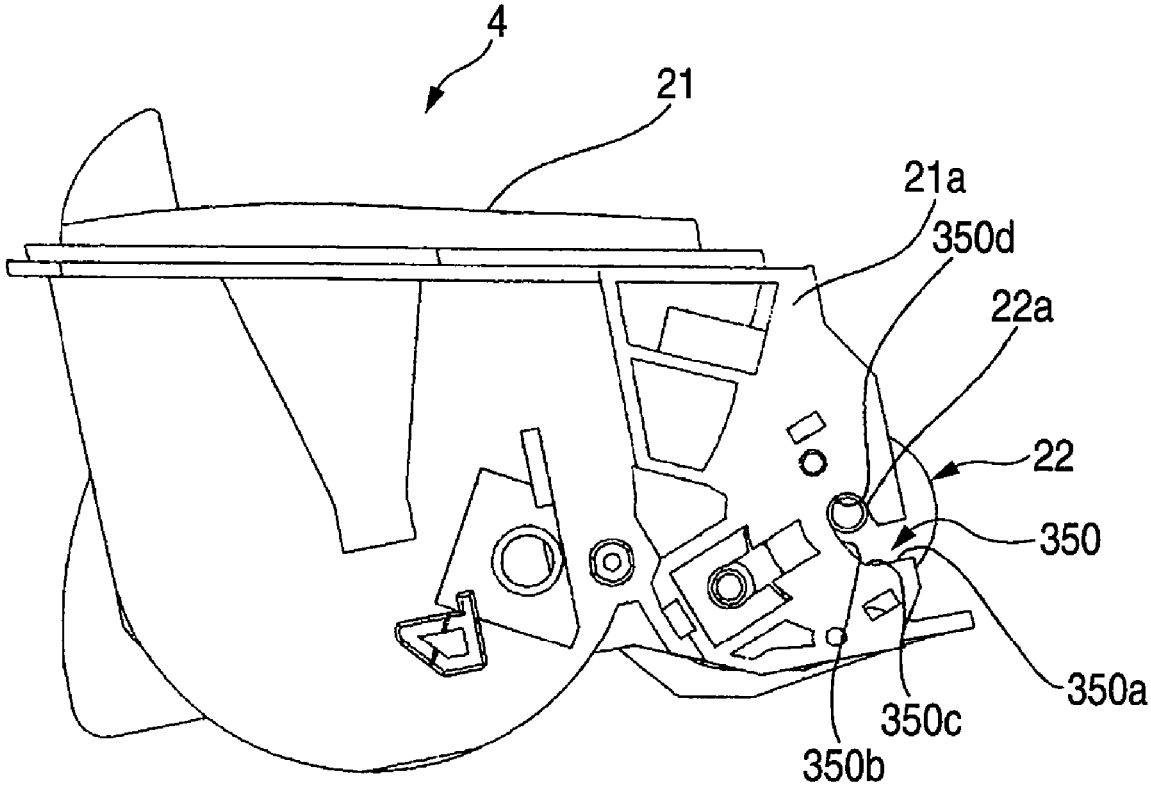
FIG. 9 is a right side view of the developing cartridge in a state that the developing roller is completely attached.

Thereafter, the developing roller shaft 22*a* slides along the second guide notch 350*b* and moves up to the second end portion 350*d*, by which the developing roller 22 is placed at the attaching completion position (the predetermined position) as shown in FIG. 9. In the second guide notch 350*b*, a part from the first end portion 350*c* to the second end portion 350*d* extends along the extending direction of the side seal 109. The rubber roller 22*b* is configured so that the both ends thereof rotate while slidably contacting with the side seals 109. The side seal 109 is attached along the extending direction along a circumferential surface of the rubber roller 22*b* at a longitudinal end portion thereof.

Figure 10B:
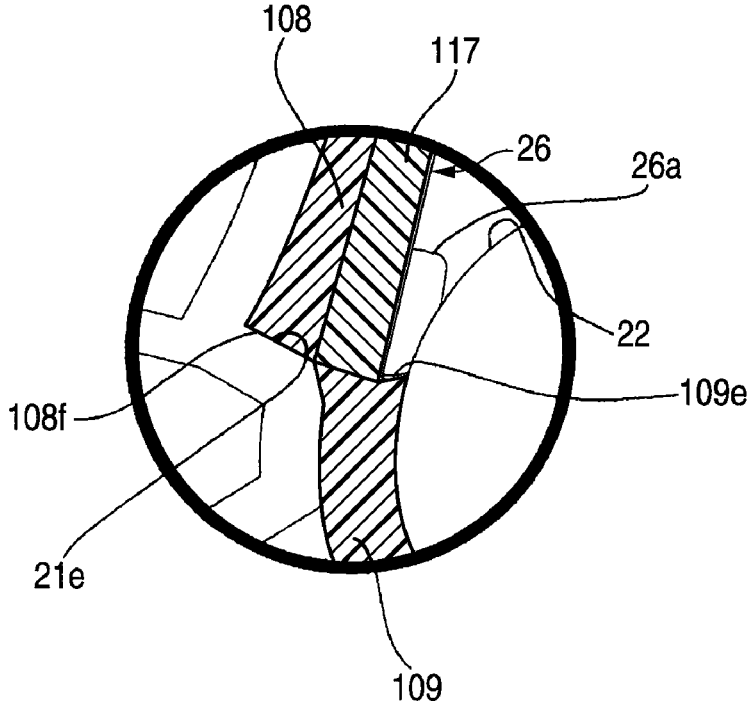

That is, the rubber roller 22*b* compresses each side seal 109 in the thickness direction at the first end portion 350*c*. Then, the developing roller shaft 22*a* moves along the second guide notch 350*b* so that the developing roller 22 slides and moves up to the second end portion 350*d* while compressing the side seal 109 with rubber roller 22*b*. Therefore, as shown in FIG. 10B, the side seal 109 is pressed toward an upper end side 109*e* located on the downstream side of a rotation direction of the developing roller 22 due to friction between the side seal 109 and the surface of the rubber roller 22*b*. More specifically, in a state where the developing roller 22 is placed at the attaching completion position, a face which is in a sliding contact with the rubber roller 22*b* on the upper end side 109*e* of the side seal 109 is pressed toward the blade 26. Further, in response to such action, the side seal 109 is also subjected to be pressed toward a rib sponge 117. The rib sponge 117 is attached to the back face of the blade 26 while contacting edges of the side seal 109 at the downstream side of a rotation direction of the developing roller.

When the developing roller 22 is attached by an operator, the case 21 is often placed on a work table, with the toner container 24 placed below in the vertical direction, and with the developing chamber 28 and the opening 340 placed above in the vertical direction. In this state, when the developing roller 22 is located at the first end portion 350*c*, the side seal 109 is compressed in the direction of thickness by the weight of the developing roller 22 itself. Therefore, the operator is not required to have special skill in pressing the side seal 109 in the thickness direction. Further, only by a simple operation in which the operator slides the developing roller 22 along the second guide notch 350*b* from the above state, it is possible to press the side seal 109 toward the attaching completion position of the developing roller 22 using friction between the surface of the rubber roller 22*b* and that of the side seal 109.

Figure 4:
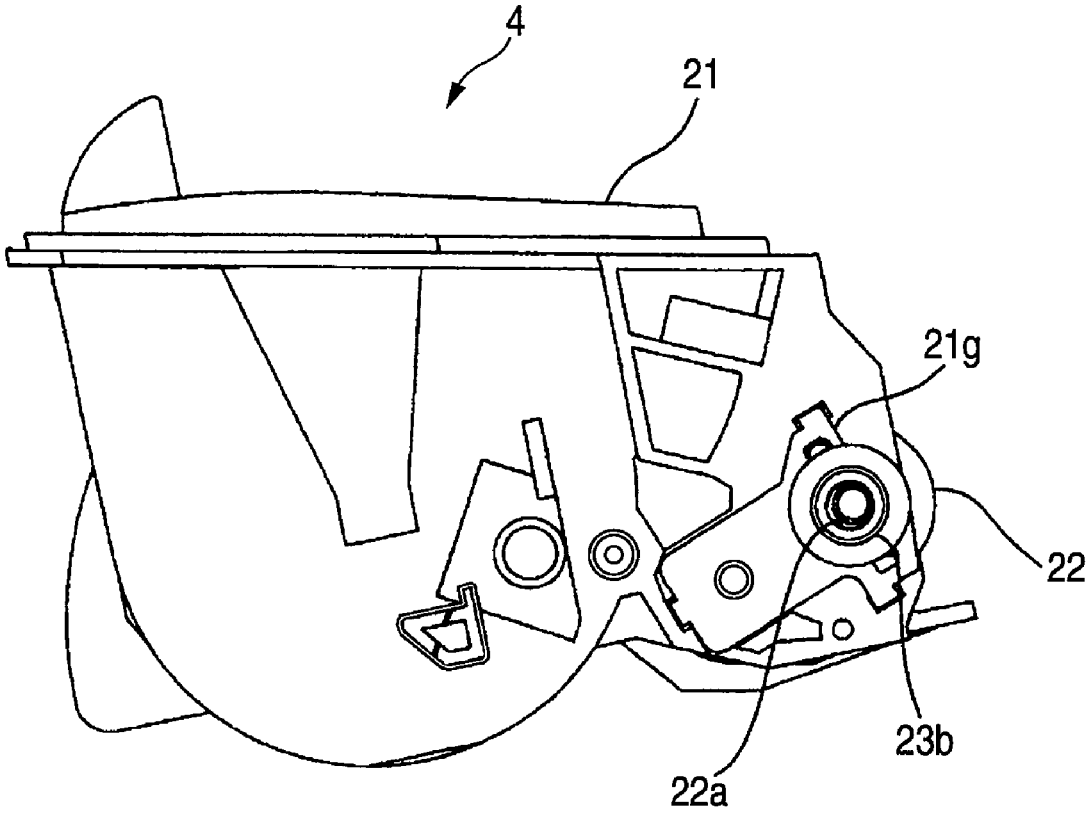
FIG. 4 is a right side view of the developing cartridge.

Thereafter, in order to keep this state, a bearing member 21*g* as a retaining member is attached to the right end of the developing roller shaft 22*a* (refer to FIG. 4). Thereafter, a bearing body 23*b* is attached. At the left end of the developing roller shaft 22*a* which is an opposite side shown in FIG. 4 (refer to FIG. 3), a bearing member as a retaining member is fixed in a similar manner. However, since a plurality of gears including a driving gear 22*c* for driving the developing roller 22 are included on this side, the bearing member has a size and configuration so as not to affect the operation of these gears. In the first example, the bearing member is smaller in diameter than the driving gear 22*c*. As described so far, after the bearing member (not visible behind the driving gear 22*c* in FIG. 3) is attached also to the left end of the developing roller shaft 22*a*, the driving gear 22*c* is fitted and the bearing body 23*a* is then attached further outside.

As described above, the bearing member 21*g* is attached for retaining the developing roller 22 at an attaching completion position, by which the developing roller shaft 22*a* is fixed at the second end portion 350*d*. The bearing member 21*g* according to the first example includes a supporting hole, a diameter of which is approximately equal to that of a developing roller shaft 22*a*, and an engaging portion for positioning. The case side 21*a* includes an engage portion to be engaged with the engaging portion of the bearing member 21*g*. In this instance, the engaging portion of the bearing member 21*g* may be given as a projection for positioning and the engage portion on the case side 21*a* may be given as a hole for positioning, or vice versa. Further, the engaging portion and the engage portion may be provided in any given numbers that are able to retain the developing roller 22 at the attaching completion position of the case 21. Then, since the bearing member 21*g* is attached, the developing roller 22 is retained so as to rotate at the attaching completion position.

Further, as described above, the bearing members 21*g* may be attached outside the case side 21*a*. Alternatively, the developing roller shaft 22*a* may be inserted into the guide notch 350 in a state where the bearing members 21*g* are in advance kept attached to both end portions of the developing roller shaft 22*a*, and individually engaged inside the case side 21*a* when the developing roller shaft 22*a* is placed at the second end portion 350*d*.

Figure 11:
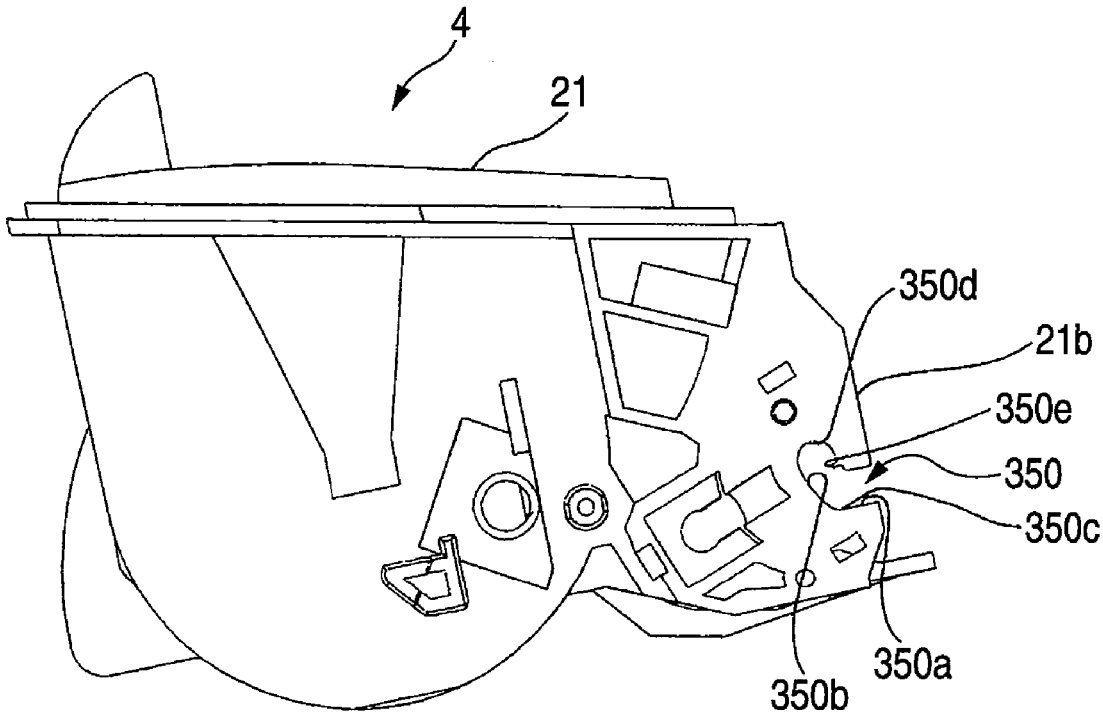
FIG. 11 is a view showing an exemplified variation of the configuration of a guide notch shown in FIG. 7.
Figure 12A:
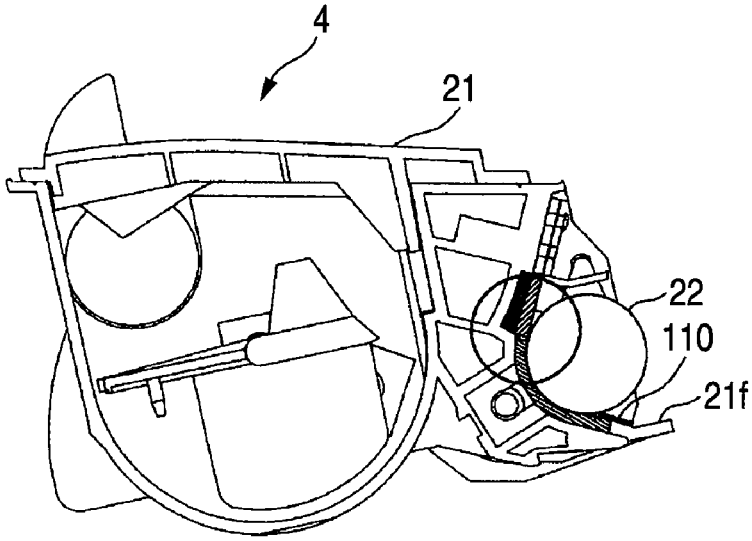
FIG. 12A is a brief sectional view showing an exemplified variation of the developing cartridge.
Figure 12B:
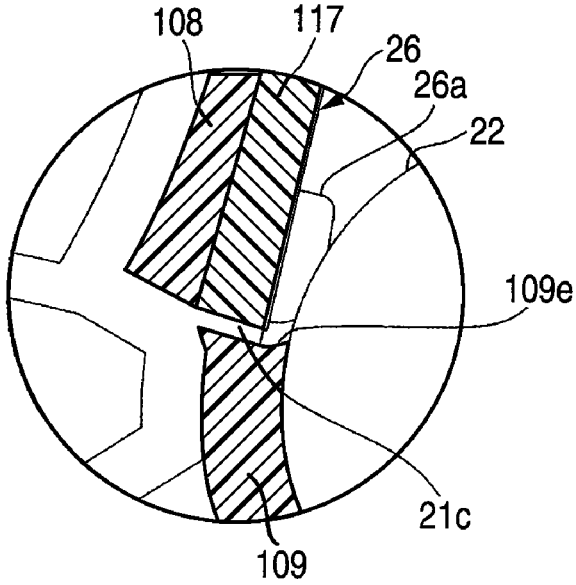
FIG. 12B is an enlarged view of major parts in FIG. 12A.
Figure 13A:
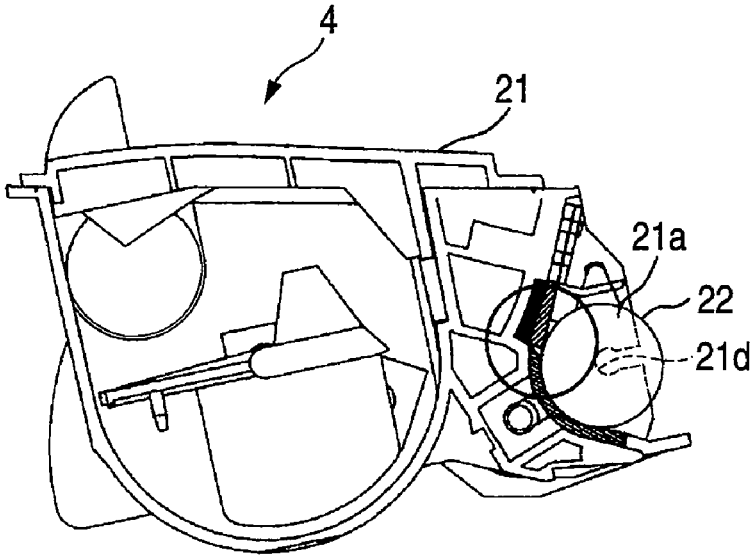
FIG. 13A is a brief sectional view of a conventional developing cartridge.
Figure 13B:
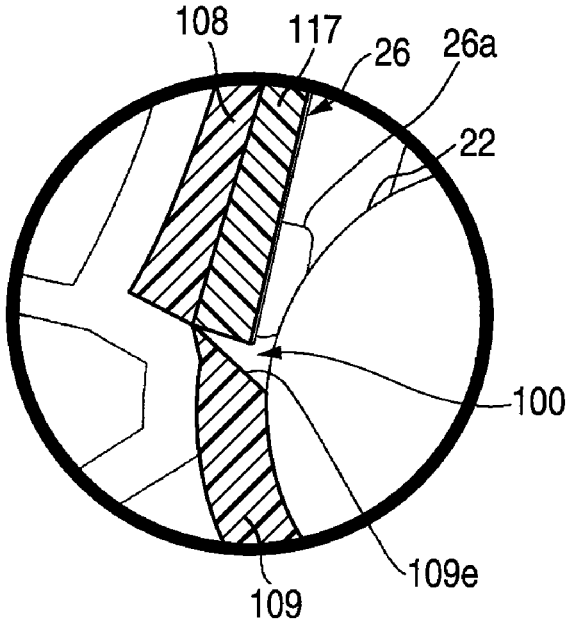
FIG. 13B is an enlarged view of major parts in FIG. 13A.

Further, in place of engaging the bearing members, it may be possible to fix the developing roller 22 at the attaching completion position by modifying a configuration of the guide notch 350 by itself. Specifically, as shown in FIG. 11, the projection 350*e* as a retaining member projects toward the second guide notch 350*b* on the opening-side front edge 21*b* side of the guide notch 350 (the side opposite the second guide notch 350*b*). Since the projection 350*e* projects toward the second guide notch 350*b*, a clearance between the second guide notch 350*b* and the opposite side becomes narrow. Thereby, when the developing roller shaft 22*a* is moved beyond the projection 350*e* and arranged at the second end portion 350*d*, the developing roller shaft 22*a* is fixed at the position concerned. This projection 350*e* is formed on the side of opening-side front edge 21*b* of the guide notch 350, and not formed on the second guide notch 350*b* which is the opposite side thereof. When a projection is formed on the second guide notch 350*b*, the developing roller shaft 22*a* sliding along the second guide notch 350*b* becomes loose by the projection. Then, the side seal 109 fails to be pressed effectively toward the attaching completion position. However, since the second guide notch 350*b* according to the first example is formed as a smooth guide up to the second end portion 350*d*, the developing roller shaft 22*a* slides up to the second end portion 350*d* while the side seal 109 is kept compressed in the thickness direction, whereby the side seal 109 is effectively pressed toward the attaching completion position.

As described above, an operator only slides the developing roller 22 along the guide notch 350, whereby the side seal 109 is pressed toward the attaching completion position of the developing roller 22. It may be possible to suppress formation of a clearance in the vicinity of the upper end side 109*e* of the side seal when attaching the developing roller 22. Since the side seal 109 is pressed toward the downstream side of the rotation direction of the developing roller 22, the rotation direction of the developing roller 22 coincides with a deforming direction to which the side seal 109 is forcibly deformed. Therefore, even when the developing roller 22 is rotated in the process of forming images, the falling direction of the side seal does not change. Thus, it may be possible to maintain a state in which formation of a clearance is suppressed. Further, since the side seal 109 is pressed toward the blade 26 and the rib sponge 117 on the back face of the blade 26 by the rubber roller 22*b* at the time of attaching the developing roller 22, a clearance between the side seal 109 and the blade 26 is rarely formed. Thus, it may be possible to reduce the toner leakage from this clearance. Since the side seal 109 is pressed and deformed toward the rib sponge 117 which is made of elastic material, the rib sponge 117 deforms by the action of the side seal 109. Therefore, the side seal 109 and the rib sponge 117 are firmly stuck together. Thus, it may be possible to effectively prevent toner leakage from this portion.

Second Example

The present invention shall not be restricted to the first example described above with reference to the drawings, but the following example is also included in the technical scope of the present invention. The second example is different from the first example in that the upper end side 109*e* of the side seal 109 is not in contact with the rib sponge 117 but, instead, in contact with the rib 21*c* projecting from the case 21. Other constitutions which are the same as those of the first example are given the same numerals and symbols, and a detailed description will be omitted here.

When attaching the developing roller 22 to the case 21, the developing roller shaft 22*a* is inserted along the attaching guide notch 350 in a sliding manner, and moved up to the first end portion 350*c*. In this state, the side seal 109 is kept compressed in the thickness direction by the rubber roller 22*b*. When the developing roller shaft 22*a* is slid and moved from the first end position 350*c* up to the second end portion 350*d* which is to be an attaching completion position of the developing roller 22, the side seal 109 is pressed and deformed toward the rib 21*c* (second attached member) by friction between the surface of the rubber roller 22*b* and that of the side seal 109.

Figure 14A:
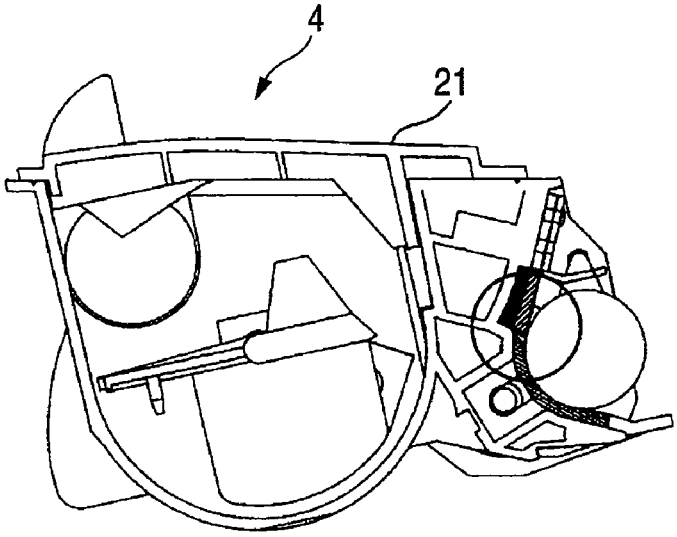
FIG. 14A is another brief sectional view of a conventional developing cartridge for comparison with that shown in FIGS. 13A and 13B.
Figure 14B:
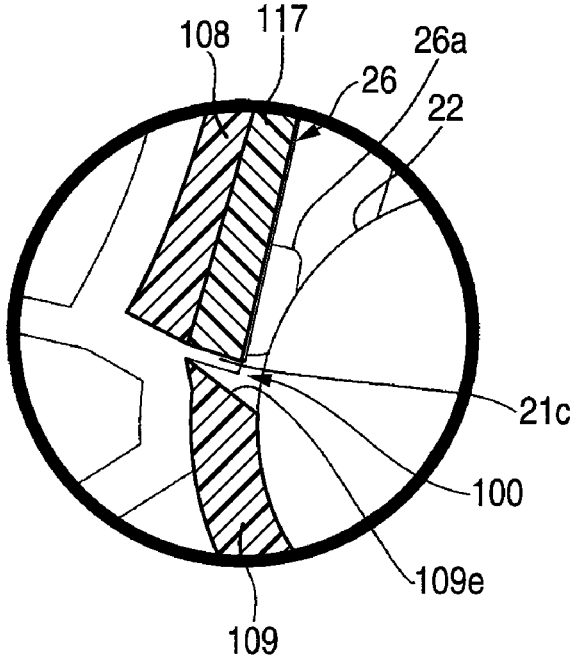
FIG. 14B is an enlarged view of major parts in FIG. 14A.

As shown in FIGS. 14A and 14B, when the developing roller 22 is attached according to a conventional method, it is impossible to predict a direction to which side the side seal 109 falls down and there are some cases where a clearance 100 as shown in FIG.14B is formed in the vicinity of the upper end side 109*e*. This clearance causes toner leakage from this part to result in scatter of toner inside a printer. However, according to the configuration of the second example, since the side seal 109 is pressed and deformed toward the rib 21*c* (projection) provided in the vicinity of a attaching completion position of the developing roller 22 when attaching the developing roller 22, a frequency of forming a clearance between the side seal 109 and the rib 21*c* is reduced and toner leakage is prevented.

What is claimed is:

1. A developing device comprising:

a developer container that contains developer, the developer container being formed with an opening for providing the developer;

a developing roller that is rotatably supported by the developer container at a predetermined position to be disposed along the opening, the developing roller including:

a roller shaft; and an elastic roller supported by the roller shaft, the elastic roller being configured to carry the developer provided through the opening;

leakage preventing members that are made of elastic material and prevent leakage of the developer at longitudinal end portions of the elastic roller, each of the leakage preventing members being respectively disposed at portions where the longitudinal end portions oppose the developer container, to extend in an extending direction along a circumferential surface of the elastic roller at a longitudinal end portion thereof;

a guide that is provided on the developer container and slidably guides the developing roller toward the predetermined position along a sliding direction that is defined along the extending direction to allow the developing roller to be attached to the developer container; and an attached member that is attached to the developer container at the vicinity of the predetermined position, wherein the guide guides the developing roller while the elastic roller presses each of the leakage preventing members toward a first attached member.

2. The developing device according to claim 1, wherein the guide guides the developing roller to the predetermined position while the elastic roller presses each of the leakage preventing members toward a direction that intersects with a sliding surface that is defined between each of the leakage preventing members and the elastic roller to forcibly deform toward the sliding direction.

3. The developing device according to claim 1, wherein the guide guides the developing roller to the predetermined position while the elastic roller presses each of the leakage preventing members respectively toward an edge thereof at a downstream side of a rotation direction of the developing roller.

4. The developing device according to claim 1, wherein the attached member is made of elastic material, and wherein edges of the leakage preventing members contact with the attached member to prevent leakage of the developer when the developing roller is attached to the developer container at the predetermined position.

5. The developing device according to claim 4, further comprising a regulating member that regulates a layer thickness of the developer carried on the elastic roller, wherein the attached member is attached between the regulating member and the developer container.

6. The developing device according to claim 1, wherein the guide includes:

a first guide that guides the developing roller to a first end portion thereof in a thickness direction perpendicular to a sliding surface that is defined between each of the leakage preventing members and the elastic roller; and a second guide that guides the developing roller from the first end portion to the predetermined position along the sliding direction, and wherein the elastic roller presses each of the leakage preventing members in the thickness direction when the developing roller is at the first end portion.

7. The developing device according to claim 1, further comprising a retaining member that retains the developing roller at the predetermined position.

8. The developing device according to claim 1, wherein the developer includes a polymerization toner produced by a polymerization method.

9. The developing device according to claim 1, wherein the guide includes a pair of guide notches formed on the developer container at longitudinal end portions of the developer container.

10. The developing device according to claim 9, wherein each of the guide notches includes:

a first guide notch that extends from a front of the developer container to a first end portion thereof in a thickness direction perpendicular to a sliding surface that is defined between each of the leakage preventing members and the elastic roller; and a second guide notch that extends from the first end portion to the predetermined position along the sliding direction, and wherein the elastic roller presses each of the leakage preventing members in the thickness direction when the developing roller is at the first end portion.

11. A developing device comprising:

a developer container that contains developer, the developer container being formed with an opening for providing the developer;

a developing roller that is rotatably supported by the developer container at a predetermined position to be disposed along the opening, the developing roller including:

a roller shaft; and an elastic roller supported by the roller shaft, the elastic roller being configured to carry the developer provided through the opening;

leakage preventing members that are made of elastic material and prevent leakage of the developer at longitudinal end portions of the elastic roller, each of the leakage preventing members being respectively disposed at portions where the longitudinal end portions oppose the developer container, to extend in an extending direction along a circumferential surface of the elastic roller at a longitudinal end portion thereof; and a guide that is provided on the developer container and slidably guides the developing roller toward the predetermined position along a sliding direction that is defined along the extending direction to allow the developing roller to be attached to the developer container, wherein the developer container includes an attached member that projects from the developer container at the end of each of the leakage preventing members, and wherein the guide guides the developing roller while the elastic roller presses each of the leakage preventing members toward the attached member.

12. A process cartridge comprising:

a developer container that contains developer, the developer container being formed with an opening for providing the developer;

a developing roller that is rotatably supported by the developer container at a predetermined position to be disposed along the opening, the developing roller including:

a roller shaft; and an elastic roller supported by the roller shaft, the elastic roller being configured to carry the developer provided through the opening;

leakage preventing members that are made of elastic material and prevent leakage of the developer at longitudinal end portions of the elastic roller, each of the leakage preventing members being respectively disposed at portions where the longitudinal end portions oppose the developer container, to extend in an extending direction along a circumferential surface of the elastic roller at a longitudinal end portion thereof;

a guide that is provided on the developer container and slidably guides the developing roller toward the predetermined position along a sliding direction that is defined along the extending direction to allow the developing roller to be attached to the developer container; and a photosensitive member including a surface on which the developer carried on the elastic roller is fed, an attached member that is attached to the developer container at the vicinity of the predetermined position, wherein the guide guides the developing roller while the elastic roller presses each of the leakage preventing members toward a first attached member.

13. The process cartridge according to claim 12, wherein the attached member is made of elastic material, and wherein edges of the leakage preventing members contact with the attached member to prevent leakage of the developer when the developing roller is attached to the developer container at the predetermined position.

14. The process cartridge according to claim 13, further comprising a regulating member that regulates a layer thickness of the developer carried on the elastic roller, wherein the attached member is attached between the regulating member and the developer container.

15. A method for attaching a developing roller to a developer container, wherein the developer container contains developer and is formed with an opening for providing the developer, wherein the developing roller is to be rotatably supported by the developer container at a predetermined position to be disposed along the opening and includes a roller shaft and an elastic roller that is supported by the roller shaft and is configured to carry the developer provided through the opening, and wherein leakage preventing members made of elastic material are disposed at portions where longitudinal end portions of the developing roller oppose the developer container, to extend in an extending direction along a circumferential surface of the elastic roller at a longitudinal end portion thereof, and wherein an attached member is attached to the developer container at the vicinity of the predetermined position, the method comprising:

guiding the developing roller so that the elastic roller presses each of the leakage preventing members in a thickness direction perpendicular to a sliding surface that is defined between each of the leakage preventing members and the elastic roller; and guiding the developing roller along a sliding direction that is defined along the extending direction while the elastic roller presses each of the leakage preventing members toward the attached member to allow the developing roller to be attached to the developer container.

16. The method according to claim 15, wherein the guiding the developing roller along the sliding direction includes causing edges of the leakage preventing members to contact with the attached member to prevent leakage of the developer, and wherein the attached member is made of elastic material.

17. The method according to claim 16, wherein the attached member is attached between a regulating member that regulates a layer thickness of the developer carried on the elastic roller, and the developer container.

* * * * *